United States Patent [19]

Foster

[11] 4,180,950

[45] Jan. 1, 1980

[54] DOME STRUCTURE

[75] Inventor: Wilbert J. Foster, Ottawa, Canada

[73] Assignee: Annan Blair, Ottawa, Canada

[21] Appl. No.: 874,403

[22] Filed: Feb. 2, 1978

[51] Int. Cl.[2] ..... E04B 1/32

[52] U.S. Cl. ..... 52/81; 52/542; 52/588

[58] Field of Search ..... 52/80, 81, 82, 588, 52/86, 536, 542

[56] References Cited

U.S. PATENT DOCUMENTS

| | | | |
|---|---|---|---|
| 799,259 | 9/1905 | Perrin | 52/536 |
| 2,934,075 | 4/1960 | Richardson et al. | 52/81 X |
| 3,026,651 | 3/1962 | Richter | 52/81 |
| 3,040,478 | 6/1962 | Ferguson | 52/81 X |
| 3,373,533 | 3/1968 | Trelfa et al. | 52/82 |
| 3,874,141 | 4/1975 | Olsen et al. | 52/81 X |

*Primary Examiner*—Carl D. Friedman

*Attorney, Agent, or Firm*—Larson, Taylor and Hinds

[57] ABSTRACT

A building unit of generally diamond shape which includes flange members along its edges, the flange members adapted to interlock with those of an adjacent unit to construct a building structure for example a dome structure. The units are simple to manufacture and assemble to provide inexpensive domes and other structures.

9 Claims, 7 Drawing Figures

DOME STRUCTURE

SUMMARY OF THE INVENTION

The present invention relates to building units, a plurality of which can be assembled to form building structures of various shapes and dimensions. The particular design of the unit is simple and as such, they are inexpensive to manufacture and easy to assemble by unskilled persons.

The invention is a building unit which consists of a panel of quadrilateral shape. Upstanding walls extend along the edges of the panel, one pair of walls being simple flanges and the other pair being inverted U-shaped flanges. Although each pair of flanges converge towards each other they remained spaced apart because the apices are truncated. A plurality of these building units can be assembled in horizontal courses to form a structure. The U-shaped flanges engage the simple flanges of a contiguous panel in a lower course while the lower end of a higher panel overlaps the upper end of a panel two courses below. The unit is particularly suitable for the fabrication of dome structures as will be described, although it is contemplated that such units can be utilized in the fabrication of various wall and roof structures.

An advantage of the structure is that it is essentially water tight in a rain storm. This is because water is shed from the building units since adjacent ones overlap where assembled. An additional advantage is that in a dome structure, no additional structural members are necessary to provide support. The units themselves may be manufactured from various materials including metal and plastic or fiberglass.

BRIEF DESCRIPTION OF DRAWINGS

For the purpose of illustration but not of limitation, embodiments of the invention will be hereinafter described with reference to the drawings, in which.

DESCRIPTION OF PREFERRED EMBODIMENT

Figure 1:
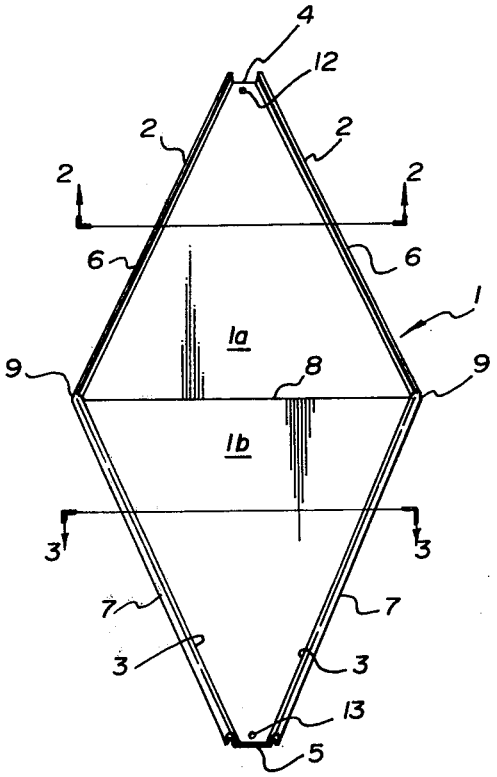
FIG. 1 is a plan view of a building unit according to the invention.

As shown in FIG. 1, the building unit comprises a panel 1 of generally diamond shape with a first pair of adjacent edges 2 being of equal length and converging towards a first apex 4 of the panel. A second pair of edges 3 converge towards a second apex 5 which is opposite the first apex 4. Two pairs of upstanding walls 6, 7 are connected to or integral with the panel portion 1 at its edges 2 and 3 respectively. These upstanding walls may be substantially orthogonal to the adjacent portion of the panel or at a small obtuse angle. The upstanding walls 6 are simple flanges which extend the length of the first pair of edges 2. The other two upstanding walls 7 are inverted U-shaped flanges which extend the length of the second pair of edges 3. The cross-sectional shape of the flanges is seen more clearly in FIGS. 2, 3 and 5.

Figure 2:
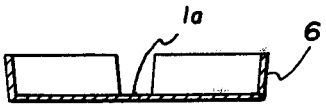
FIG. 2 shows a cross-section along line 2—2 in FIG. 1.
Figure 3:
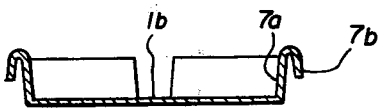
FIG. 3 shows a cross-section along line 3—3 in FIG. 1.
Figure 5:
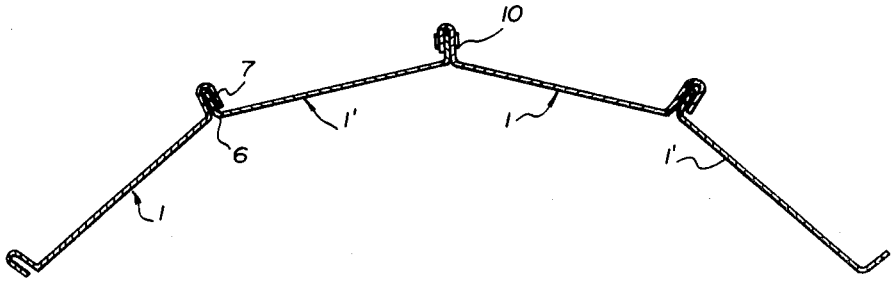
FIG. 5 is a section on the line 5—5 in FIG. 4.

As is evident from FIGS. 2 and 3, the walls 6 and 7 are at a small obtuse angle to the adjacent portions of the panel, so that when assembled, contiguous panels are angled with respect to each other as is best seen in FIG. 5.

The first apex 4 and second apex 5 are truncated and, as a result, the pair of simple flanges 6 connected to the converging edges 2, approach each other but remain spaced apart at their ends proximal the first apex 4. In the same manner, the inverted U-shaped flanges 7 along the converging edges 3 remain spaced apart at the second apex 5.

In the illustrated embodiment, the panel 1 consists of two roughly triangular planar portions 1*a*, 1*b*, which are angularly offset about line 8 which joins the points 9 where the first pair of edges 2 meet the second pair of edges 3. Alternatively, the panel portion 1 could be slightly curved.

Figure 4:
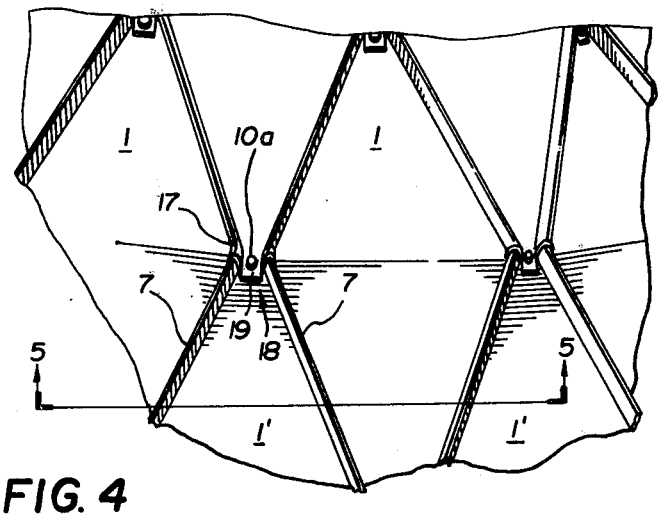
FIG. 4 shows a portion of a structure comprising a plurality of interconnected units.
Figure 6:
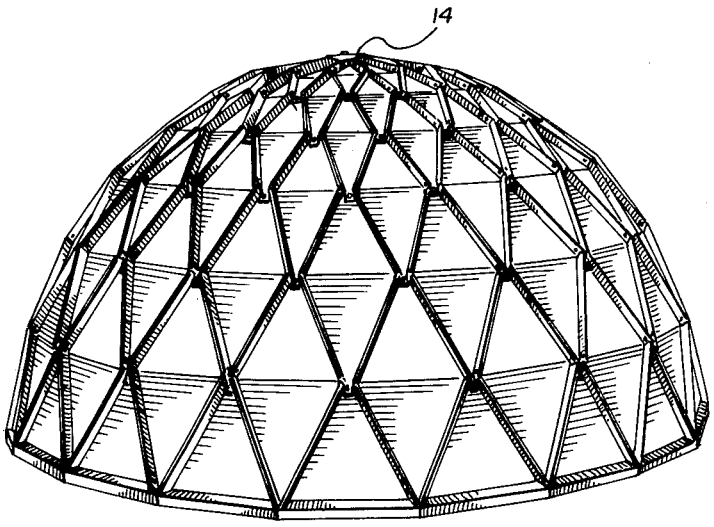
FIG. 6 shows a dome structure.
Figure 7:
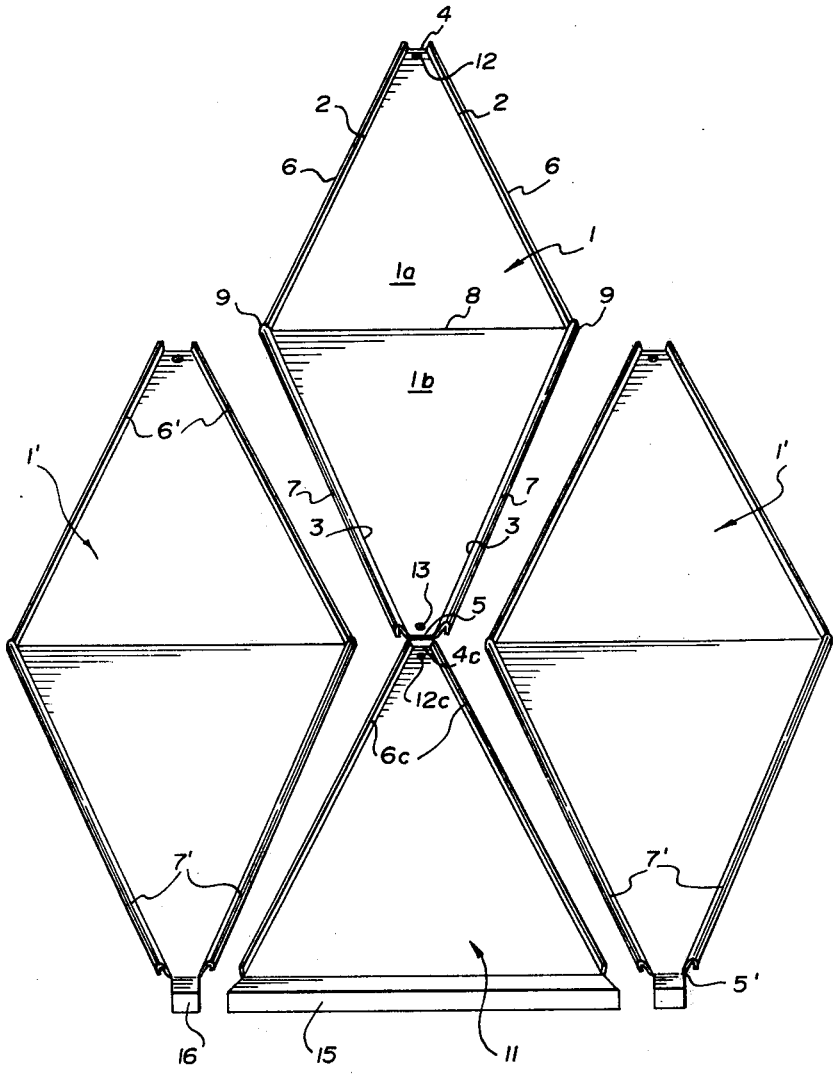
FIG. 7 shows a group of building units prior to assembly.

The units are assembled in courses as shown in FIG. 4 to form a dome as in FIG. 6, the U-shaped flanges 7 of a unit in one course engaging the simple flanges 6 of contiguous units in the adjacent course. As seen in FIGS. 2 and 3 the spacing between the walls 7*a* and 7*b* of the U-shaped flange corresponds to the thickness of the simple flanges 6 such as to provide a tight interlocking engagement. Fastening means for the mating upstanding walls (e.g. bolts rivets or by welding or otherwise) is also contemplated and is shown in FIG. 5 as bolt 10. In addition, fasteners 10*a* (FIG. 4) are passed through registering holes 12*c*, 13 (FIG. 7) in the overlapped apices of the assembled units.

For water tightness, it is necessary that the building unit be oriented in such a manner that the apex 5 is lowermost and the simple flanges 6 are above the inverted U-shaped flanges 7. The inverted U-shaped flanges 7 of a unit in one course will engage the simple flanges 6 of contiguous units of the adjacent lower course. At the same time, the lower end portion 19 of panel portion 1 in one course will overlap the upper end portion 18 of a panel portion 1 in the next but one lower course. In the dome type structure shown this overlapping arrangement allows the rainwater to shed from one panel down onto the next panel and not into the joint. Similarly, there is no gap between the flanges presented to water flowing down the lower portion 1*b* of the panel. The joint gap where the flanges 6 and 7 of contiguous panels overlap, is present along the upper edges of the lower panel and is thus largely protected from rainwater. In the assembled structure, an inverted U-shaped flange 7 always overlies a simple flange 6 and there is little likelihood of rainwater penetrating the overlapped flanges. However, if desired, additional weather-sealing means can be employed between the flanges.

In the dome structure, the panels of each successive course are smaller than the preceding lower course in order to provide the convergence of the hemisphere. This is evident from FIGS. 6 and 7. Since the lower edge of the dome is flat, there are triangular gaps between the units 1' of the lower most course. These gaps are filled by triangular shaped building units 11 similar in design to the upper half of a building unit 1 bounded by simple flanges 6 and line 8. Thus the triangular unit 11 (FIG. 7) has inclined edges bearing simple flanges 6*c* and apex 4*c* with a hole 12*c* therethrough. The lower edge of the unit 11 is strengthened by an angled flange 15 forming a base for the dome. A simple circular cap 14 can seal the top of the dome structure.

The lower apex 5' of each building unit 1' of the lowest course has an extension 16 of a shape corresponding to that of the flange 15. In the assembled condition the extension 16 overlaps the gaps between the flanges 15 of adjacent units 11 and prevents the egress of rainwater. Suitable fastening means (not shown) may be provided to secure the extension 16 to the flanges 15.

As has been discussed, the cooperating configuration of the U-shaped flanges 7 and simple flanges 6 prevents entry of water into the joints between the building units. To enhance this weather-proofing, the lower end of each U-shaped flange 7 has a curved flared extension 17 as seen best in FIG. 4. In the assembled condition the flared extension overlaps the upper edge of the flange 7 of the contiguous building unit of the adjacent lower course, thus preventing entry of water at that point. Similarly, as is also shown in FIG. 4, the lower apex of the unit has an extension 19 to increase the degree of overlap and weather-proofing at this location.

A major advantage of the building unit as described above is that it is capable of being assembled into self-supporting free-standing structures such as the dome shown in FIG. 6 without the need for any additional supporting or bracing structure other than the building units themselves. By suitably selecting the dimensions of the units, domes of any size can be constructed, but only in domes of the largest sizes or those subject to abnormal loading conditions would any additional bracing be required. The dome as described herein derives its strength from the configuration of the mating flanges 6 and 7. Thus, while the unit 1 may be fabricated by bending and folding from light gauge sheet metal, such as aluminum, steel etc, the overlapped flanges form a series of zig-zag strengthening ribs extending up the wall of the dome, and resisting deflection of the dome structure. This strengthening effect is enhanced by the provision of fastening means securing together the overlapped flanges. Any suitable fastening means may be employed for this purpose, for example nut-and-bolt fasteners or where the dome is not intended to be disassembled after erection, more permanent fastening means such as rivets or spot or seam welding.

While in the above described example the building units are fabricated in sheet metal, it will be evident that other materials can be employed, and that numerous details of the structure of the invention can be modified, within the scope of the appended claims. Thus the building units 1 could be fabricated by moulding in plastics, glass fibre or other suitable material. Particularly when formed by moulding, the units could be formed with panels which are spherically curved rather than, as shown, with two flat triangular sections 1*a*, 1*b*.

Furthermore, the dome could be provided with doors, windows etc. by replacing or modifying various units or groups of units. The surface of the dome can be covered with various coatings such as plastic or paint. Insulation can also be applied either by affixing it directly onto the surface or by blowing it between the outer surface of the dome and a plastic or other covering over the dome.

What I claim as my invention is:

1. A building unit comprising a panel of quadrilateral shape having an outwardly facing surface, a first pair of adjacent edges of equal length and converging towards a first apex of the panel, a second pair of adjacent edges also of equal length and converging towards a second opposite apex of the panel, four upstanding walls connected to and extending the length of the four edges of said panel, the walls which are upstanding from said first pair of edges being simple flanges extending upwardly on the same side of the panel as said outwardly facing surface and generally perpendicular thereto, and the walls which are upstanding from said second pair of edges being, in cross-section, inverted U-shaped flanges comprising an upstanding flange which extends upwardly on the same side of the panel as the outwardly facing surface, and generally perpendicular thereto, and which turns outwardly, away from the panel and downwardly to form a U-shaped channel having a recess constructed to receive a said simple flange of another similar panel, said apices of said panel being truncated such that the ends of the pairs of flanges converging to the apices are spaced apart, such that a plurality of such units can be assembled together in successive horizontal courses to form a wall wherein the inverted U-shaped flanges of one panel in a first course are engagable with the simple flanges of contiguous units in a second lower course and such that said second truncated apex of said one panel in the first course over-laps said first truncated apex of a panel in a third lower course.

2. A building unit as defined in claim 1 in which the said panel is bent along a line which joins the points at which the first pair of edges meet the second pair of edges to form two triangular planar sections, such that a curved wall structure can be assembled.

3. A building unit as defined in claim 1 in which the said panel is curved.

4. A building unit as defined in any one of claims 1, 2 or 3 in which the distance between the sides of the inverted U-shaped flange corresponds to the thickness of the said simple flange to provide interlocking engagement between contiguous assembled panels.

5. A building unit as defined by claim 1, which further includes a bore in said panel adjacent each of said first apex and said second apex whereby said unit may be connected by fastening means passed through said bores.

6. A building unit as defined in claim 5 further including sealing means associated with said fastening means.

7. A dome structure comprised of an assembly of building units according to claim 1 wherein said building units in each successive higher course are of reduced size and the units in each course are curved in a direction parallel to the axis joining said first apex and said second apex.

8. An assembly comprised of a plurality of building units according to claim 1, wherein the building units are arranged with said first apices uppermost with their two inverted U-shaped flanges overlying and receiving in their channels simple flanges of two adjacent similar building units on a second lower course and with their two simple flanges received within channels of inverted U-shaped flanges of two adjacent similar building units on the next higher course.

9. An assembly according to claim 8, wherein the inverted U-shaped flanges of each building unit extend downwardly far enough to pass over the upper edge of the U-shaped flanges on the same panels as the simple flanges which they receive in their channels.

* * * * *

UNITED STATES PATENT AND TRADEMARK OFFICE

CERTIFICATE OF CORRECTION

PATENT NO. : 4,180,950

DATED : January 1, 1980

INVENTOR(S) : Wilbert J. Foster

It is certified that error appears in the above-identified patent and that said Letters Patent are hereby corrected as shown below:

In the heading of the above identified patent, please delete the present designation of Assignee and substitute therefor --[73] Assignee:

Allan Blair, Ottawa, Ontario, Canada, a part interest --.

Signed and Sealed this

*Eighth* Day of *April 1980*

[SEAL]

*Attest:*

SIDNEY A. DIAMOND

*Attesting Officer*

*Commissioner of Patents and Trademarks*